US009879398B2

(12) United States Patent
Azarkh et al.

(10) Patent No.: US 9,879,398 B2
(45) Date of Patent: Jan. 30, 2018

(54) WELD-FREE GEOCELL WITH CELLULAR STRUCTURE FOR SOIL STABILIZATION

(71) Applicant: OBSHCHESTVO S OGRANICHENNOY OTVETSTVENNOSTYU "MIKI", Moskovskaya obl., g. Khimki, mkr. Skhodnya (RU)

(72) Inventors: Mikhail Mikhailovich Azarkh, Moscow (RU); Aleksandr Vladimirovich Odinokov, Moscow (RU)

(73) Assignee: OBSHCHESTVO S OGRANICHENNOY OTVETSTVENNOSTYU MIKI, Moskovskaya obl., g. (RU)

( * ) Notice: Subject to any disclaimer, the term of this patent is extended or adjusted under 35 U.S.C. 154(b) by 0 days.

(21) Appl. No.: 15/309,882

(22) PCT Filed: May 15, 2015

(86) PCT No.: PCT/RU2015/000302

§ 371 (c)(1),
(2) Date: Nov. 9, 2016

(87) PCT Pub. No.: WO2015/178805

PCT Pub. Date: Nov. 26, 2015

(65) Prior Publication Data

US 2017/0145651 A1 May 25, 2017

(30) Foreign Application Priority Data

May 21, 2014 (RU) ..... 2014120517

(51) Int. Cl.
*E02D 17/20* (2006.01)
*E01F 7/04* (2006.01)

(52) U.S. Cl.
CPC ..... *E02D 17/202* (2013.01); *E01F 7/045* (2013.01); *E02D 2200/13* (2013.01);
(Continued)

(58) Field of Classification Search
CPC ..... E02D 17/202; E02D 17/20; Y10T 428/24157; Y10T 428/24273
(Continued)

(56) References Cited

U.S. PATENT DOCUMENTS 4,778,309 A * 10/1988 Bach ..... E02D 29/02 405/284
4,798,498 A * 1/1989 Hallberg ..... E02D 17/202 135/117
(Continued)

FOREIGN PATENT DOCUMENTS

RU 2090702 C1 9/1997
RU 84393 U1 7/2009
(Continued)

*Primary Examiner* — Frederick L Lagman
(74) *Attorney, Agent, or Firm* — Andrew W. Chu; Craft Chu PLLC

(57) ABSTRACT

Geocell structures stabilize water body shorelines and beds, slopes and retaining wall bridge abutments in such areas of construction as the oil and gas, transport and hydraulic engineering industries, amongst others. A blank for producing a weld-free geocell is made from a polymer sheet material having incisions therein in the form of segments of parallel lines. Adjacent incisions in the same row have a distance S between the ends thereof and the relationship S/L=K1, where K1 is from 0.1 to 0.5. The incisions of adjacent rows are at a distance D from each other and have the relationship D/L=K2, where K2 is from 0.1 to 0.7. At the ends of the incisions, there are openings which are oval or circular in shape. A weld-free geocell includes at least one
(Continued)

blank stretched in a direction perpendicular to the lines of the incisions to form a three-dimensional cellular structure.

17 Claims, 3 Drawing Sheets

(52) U.S. Cl.
CPC ..... *E02D 2200/1607* (2013.01); *E02D 2300/0068* (2013.01); *E02D 2300/0085* (2013.01); *Y10T 428/24157* (2015.01)

(58) Field of Classification Search
USPC ..... 405/302.4, 302.6, 302.7; 428/116, 117, 428/131, 136
See application file for complete search history.

(56) References Cited

U.S. PATENT DOCUMENTS 4,804,293 A * 2/1989 Varkonyi ..... E02B 3/126 405/15
4,965,097 A * 10/1990 Bach ..... E02D 17/20 405/16
5,147,150 A * 9/1992 Berkhout ..... E02D 17/202 405/129.9
5,449,543 A * 9/1995 Bach ..... E02D 17/20 405/302.6
6,296,924 B1 * 10/2001 Bach ..... E02D 17/202 405/15
6,457,863 B1 * 10/2002 Vassallo ..... B65D 33/007 150/129
6,481,259 B1 * 11/2002 Durney ..... B21D 5/00 229/931
6,484,473 B1 * 11/2002 Hall ..... E01C 3/006 405/17
6,699,563 B1 * 3/2004 Alhamad ..... A62C 3/06 169/45
7,842,373 B2 11/2010 Halahmi
8,173,241 B2 * 5/2012 Halahmi ..... E02D 17/20 405/262
8,790,036 B2 * 7/2014 Halahmi ..... E02D 17/202 404/28
9,388,536 B2 * 7/2016 De Vries ..... D04H 11/00
2006/0105142 A1 * 5/2006 Shiga ..... C09J 7/026 428/136
2006/0147275 A1 * 7/2006 Lin ..... E02D 17/20 405/302.4
2010/0080659 A1 * 4/2010 Halahmi ..... E02D 17/202 405/302.4
2012/0061029 A1 * 3/2012 Weston ..... E06B 9/06 160/6

FOREIGN PATENT DOCUMENTS

RU 122393 U1 11/2012
WO WO 9725487 A1 * 7/1997 ..... E02D 17/20

* cited by examiner

WELD-FREE GEOCELL WITH CELLULAR STRUCTURE FOR SOIL STABILIZATION

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates to the construction industry, namely, to geocell structures, and may be used for reinforcing water basin shorelines and beds, slopes, embankment cones, retaining walls in oil- and gas, transport, hydraulic engineering and other fields of construction, where geocells should have high and stable parameters of strength and endurance.

2. Description of Related Art Including Information Disclosed Under 37 CFR 1.97 and 37 CFR 1.98

The GEOWEB geocell for slope stabilization is known in the art, which is made of polymer strips interconnected in staggered order with a preset pitch along their transverse ribs and fixed on a slope in their stretched state so as to form rhomboid cells (see: RU Patent No. 2152479, E02D17/20, 2000).

Also, a geocell is known that is formed by strips of a polymeric material arranged on a polymeric base so as to form cells for confinement of a bulk material, which walls are partially bent in the direction opposite to that of a slope grade (see: CH Patent No. 652155, E02D17/20, 1985).

A geocell is known that is made of a polymeric material with rhomboid cells formed by perforated polymeric strips when this geocell is stretched, cell positions on a slope being fixed with anchors, and the cells themselves are filled with a bulk material (see: JP Patent No. 56016730, E02D17/20, 1981).

The known geocell designs for stabilization of soil structures cannot fully achieve the objective of fixing a material on a slope due to possible shift of such geocell down the slope under the influence of its filling material both during infilling a material into its cells and during the operation after infilling said material into cells, wherein said filling material being a peat-sand mixture, coarse gravel, or a combination of various bulk materials; in the result, a preset slope profile may be lost due to filling material accumulation at its base.

A geocell blank is known in the art that is made of a sheet material wherein apertures of a segmental shape are formed in rows, adjacent rows being offset relative to each other (see: RU Patent No. 2090702, 20 Sep. 1997). This geocell is formed by stretching said blank for achieving a cellular confinement structure. A drawback of this blank is that plastic deformation of the sheet material occurs when it is stretched, which may result in non-equivalent strength of the geocell. Moreover, the wall thickness in the formed cell, i.e. a distance between the borders of adjacent segmental apertures, is inconsistent. Stresses are concentrated in thinner parts of the walls, which reduces the geocell tensile strength.

The closest analog of the claimed invention is a sheet blank, a weld-free geocell produced therefrom as well as a method for producing said geocell that are all described in the Prior Art section of RU Patent No. 2090702, 20 Sep. 1997. This blank is made in the form of a polymeric sheet having slit incisions offset relative to each other. A weld-free geocell may be formed by stretching this blank. A drawback of this closest analog is low tensile strength of a geocell also, since stresses are concentrated at the ends of said slit incisions during stretching.

BRIEF SUMMARY OF THE INVENTION

The objective of the present invention is to eliminate drawbacks existing in the prior art.

The technical effect is improved tensile strength of a geocell and reduced labor-intensiveness for making it.

The above technical effect is achieved in a blank intended for forming a weld-free geocell due to that it is made of a sheet polymeric material provided with incisions in the form of parallel line segments, said segments being of same length and being arranged in rows, and the lines of incisions in adjacent rows being offset along the direction of the incisions. Adjacent incisions (2) in the same row ($R_1$, $R_2$, . . . $R_N$) have a distance S between the ends thereof and the relationship S/L=K1, where K1 is from 0.1 to 0.5; the incisions (2) in adjacent rows ($R_1$, $R_2$, . . . $R_N$) are at a distance D from each other and have the relationship D/L=K2, where K2 is from 0.1 to 0.7; and oval or circular openings are made at the incision ends.

Furthermore, the above technical effect is achieved in particular embodiments of the blank due to that:

- the blank is made in the form of a strip;
- the sheet polymeric material is reinforced by mesh;
- said mesh is produced from aramid or carbon fibers;
- K1 is in the range from 0.3 to 0.35;
- the blank is provided with additional openings for tendons required for fixing a geocell on a slope in the stretched state;
- the blank is provided with additional openings for tendons, which are arranged in staggered order along parallel lines between the rows of incisions, adjacent additional openings along the direction longitudinal relative to the direction of the incision lines are arranged at the S+L distance from each other and along the direction transverse relative to the direction of the incision lines—at the 2D distance from each other;
- the blank is provided with additional drain openings;
- said sheet polymeric material is made texturized;
- the blank is provided with reinforcing ribs made in the form of sheet material bulges oriented transversely and/or lengthwise relative to the incision lines;

the blank is made of a color polymeric material.

The above technical effect can be achieved by the weld-free geocell structure that comprises at least one said blank stretched in the direction perpendicular to the incision lines so as to form a cellular confinement structure.

Furthermore, the above technical effect can be achieved in particular embodiments of the geocell structure due to that:

- at least one tendon is drawn through the blank for the purpose of fixing the geocell on a slope;
- a geocell can be made of several one blanks forming the geocell sections and interconnected by said tendon;
- a geocell may be made with the possibility of being fixed, when in stretched state, on a slope with anchors;
- a geocell may be made with the possibility of filling its cells with filling materials, such as sands and/or coarse gravel, and/or peat-sand mixture, and/or concrete.

The above technical effect can be achieved by a method for producing a weld-free geocell, comprising providing a sheet polymeric material with incisions in the form of segments of parallel lines having the same length L and arranged in rows ($R_1$, $R_2$, . . . $R_N$), wherein the incision lines in adjacent rows are offset along the direction of said incisions, adjacent incisions (2) in a row ($R_1$, $R_2$, . . . $R_N$) being made at a distance S between the ends thereof, and the relationship S/L=K1, where K1 is in the range from 0.1 to 0.5, and the incisions (2) in adjacent rows ($R_1$, $R_2$, . . . $R_N$) being made at a distance D from each other, the relationship D/L=K2, where K2 is in the range from 0.1 to 0.7.

Furthermore, the above technical effect is achieved in particular embodiments of the method due to that:

- a sheet polymeric material reinforced by mesh is used;
- the sheet polymeric material used is texturized;
- the method comprises providing the sheet polymeric material with additional openings through which tendons are drawn for the purpose of fixing the geocell in the stretched state on a slope;
- the method further comprises providing the sheet polymeric material with additional drain openings.

BRIEF DESCRIPTION OF THE SEVERAL VIEWS OF THE DRAWINGS

The invention is explained by the accompanying drawings.

DETAILED DESCRIPTION OF THE INVENTION

Figure 1:
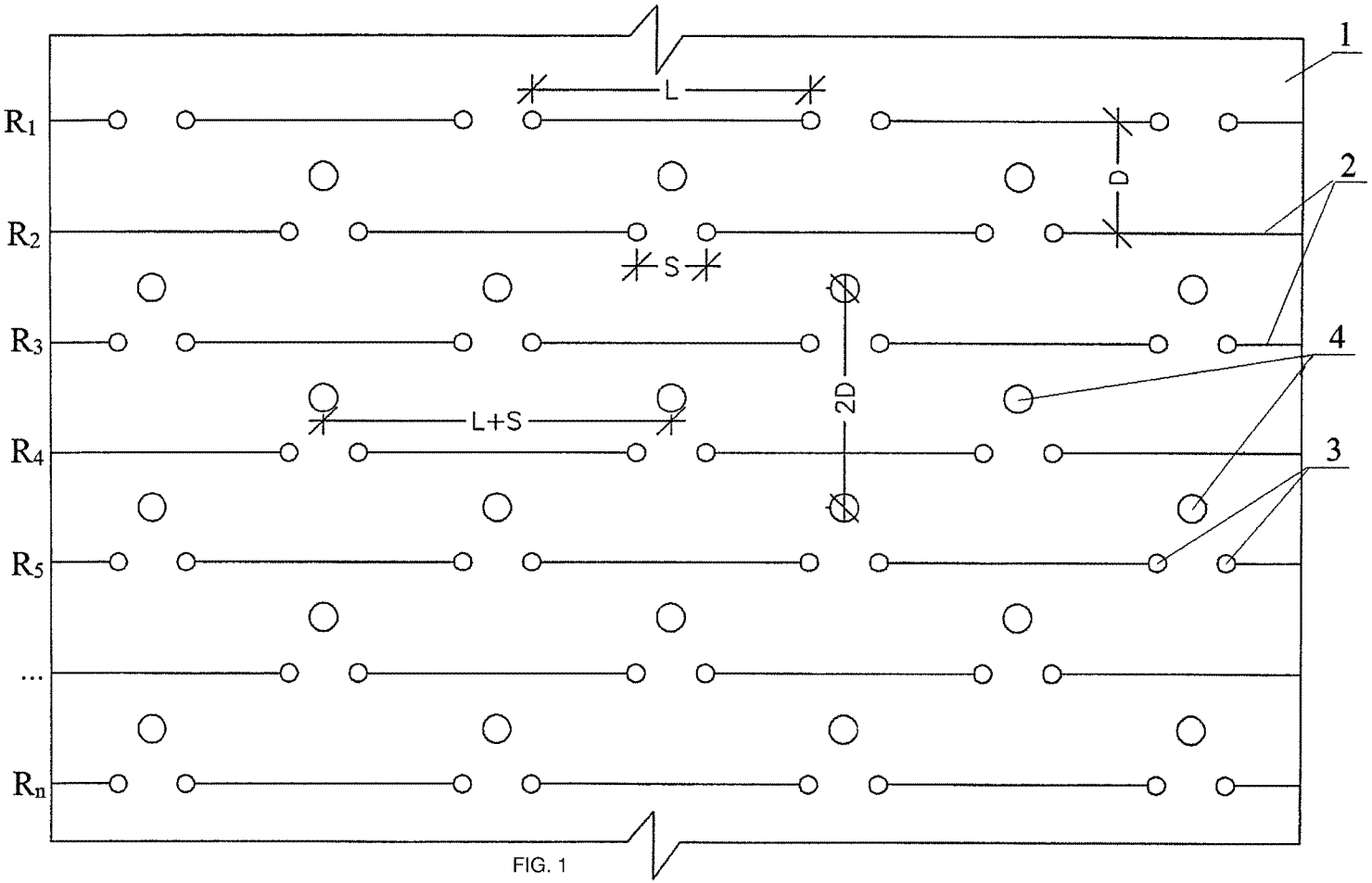
FIG. 1 shows a schematic view of a blank suitable for producing a weld-free geocell.

The claimed blank for producing a weld-free geocell (FIG. 1) is made as a sheet polymeric material 1 (in particular, a polymer strip) provided with slit incisions 2 in the form of segments of parallel lines, preferably being straight lines. These incisions are arranged in staggered order in several rows (R1, R2, . . . RN), that is, segments in adjacent rows are offset relative to each other in the longitudinal direction (along the directions of the incisions). Each of the incisions 2 has an oval or circular opening 3 at its end, which enables to attain more equal distribution of stresses in the areas of the incision ends when the blank is stretched.

The incisions 2 (except for those at the sheet edges) have the same length L and are disposed at the same distance S between the ends of the adjacent incisions in every row (R1, R2, . . . RN) (in the longitudinal direction) and at the same distance D between the incisions of adjacent rows (R1, R2, . . . RN) (in the transverse direction). The relationship S/L=K1, where K1 is in the range from 0.1 to 0.5, most preferably from 0.3 to 0.35; and the relationship D/L=K2, where K2 is in the range from 0.1 to 0.7. These distances between the linear incisions ensure the most uniform distribution of stresses arising during stretching of a blank, which improves tensile strength of a geocell, while maintaining its main functional properties.

The coefficients K1 and K2 are selected from the above ranges, depending on particular conditions of the geocell use. For example, if the claimed geocell is used for reinforcing a slope with the gradient angle of 45°, the coefficient K2 should be taken equal to 0.7.

According to preferable embodiments, the sheet material 1 is provided with additional openings 4 for tendons 5 (FIGS. 1, 3) intended for fixing the geocell in the stretched state on a slope, for example. The openings 4 for tendons are made on parallel straight lines disposed in staggered order between the rows (R1, R2, . . . RN) of the incisions 2, the adjacent openings 4 being disposed at the distance S+L from each other in the longitudinal direction (relative to the K incision lines) and at the distance 2D in the transverse direction.

Furthermore, the sheet 1 may be also provided with additional drain openings 6 (FIGS. 2, 3; not shown in FIG. 1) intended for water drainage from soil to be reinforced with the geocell.

According to one particular embodiment of the invention, the polymeric material sheet 1 may be additionally reinforced with mesh made of aramid (e.g., Kevlar, SVM), or carbon (Carbon), or other fibers (not shown in the drawings) that increase the blank strength in the transverse and longitudinal directions, which makes the geocell cellular structure uniformly strengthened due to the absence of unreinforced welds.

Furthermore, the surface of the blank sheet material 1 may be made texturized in order to improve geocell adhesion to soil.

Also, the blank may have reinforcing ribs made as sheet bulges and oriented in the perpendicular and/or lengthwise direction (not shown in the drawings) relative to the incision lines in order to improve the structure stability.

The sheet 1 may be made of a color polymeric material, which enables to use the stretched geocell for advertising or information purposes.

Figure 2:
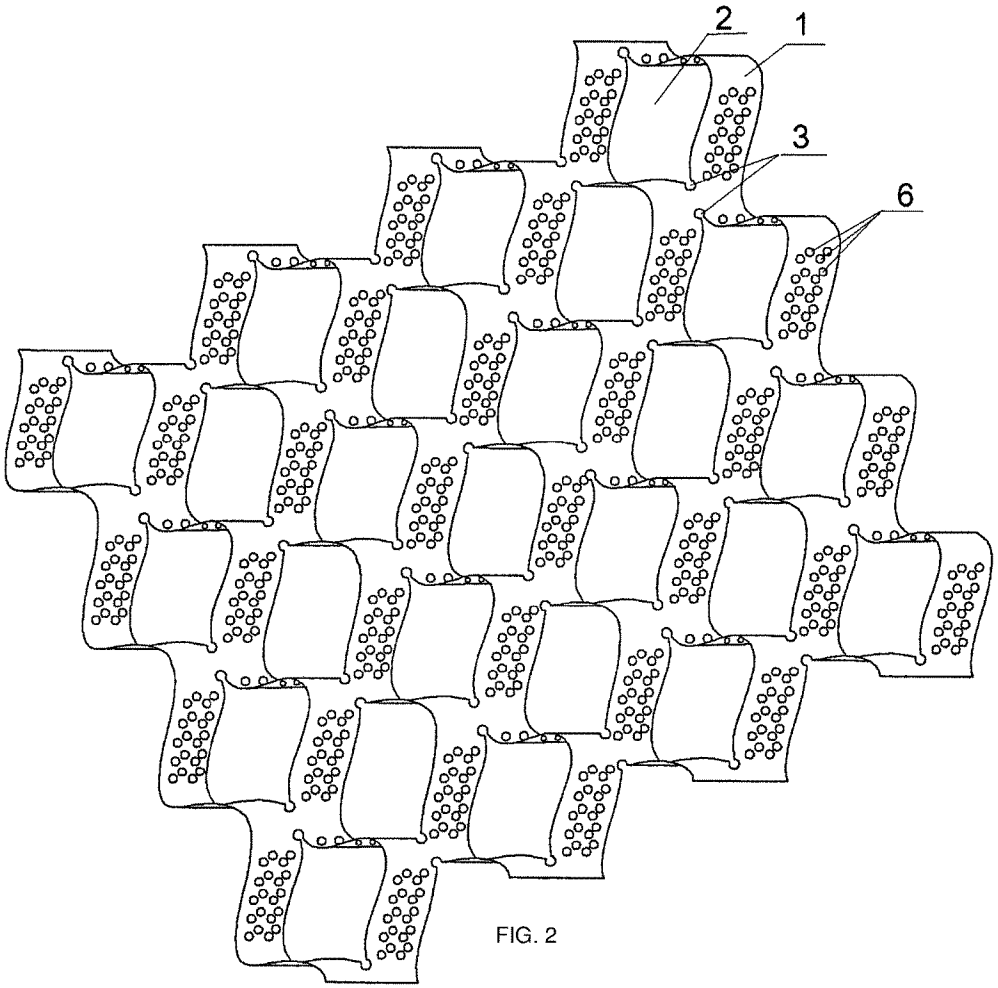
FIG. 2 shows a schematic view of the structure of a weld-free geocell thus produced.
Figure 3:
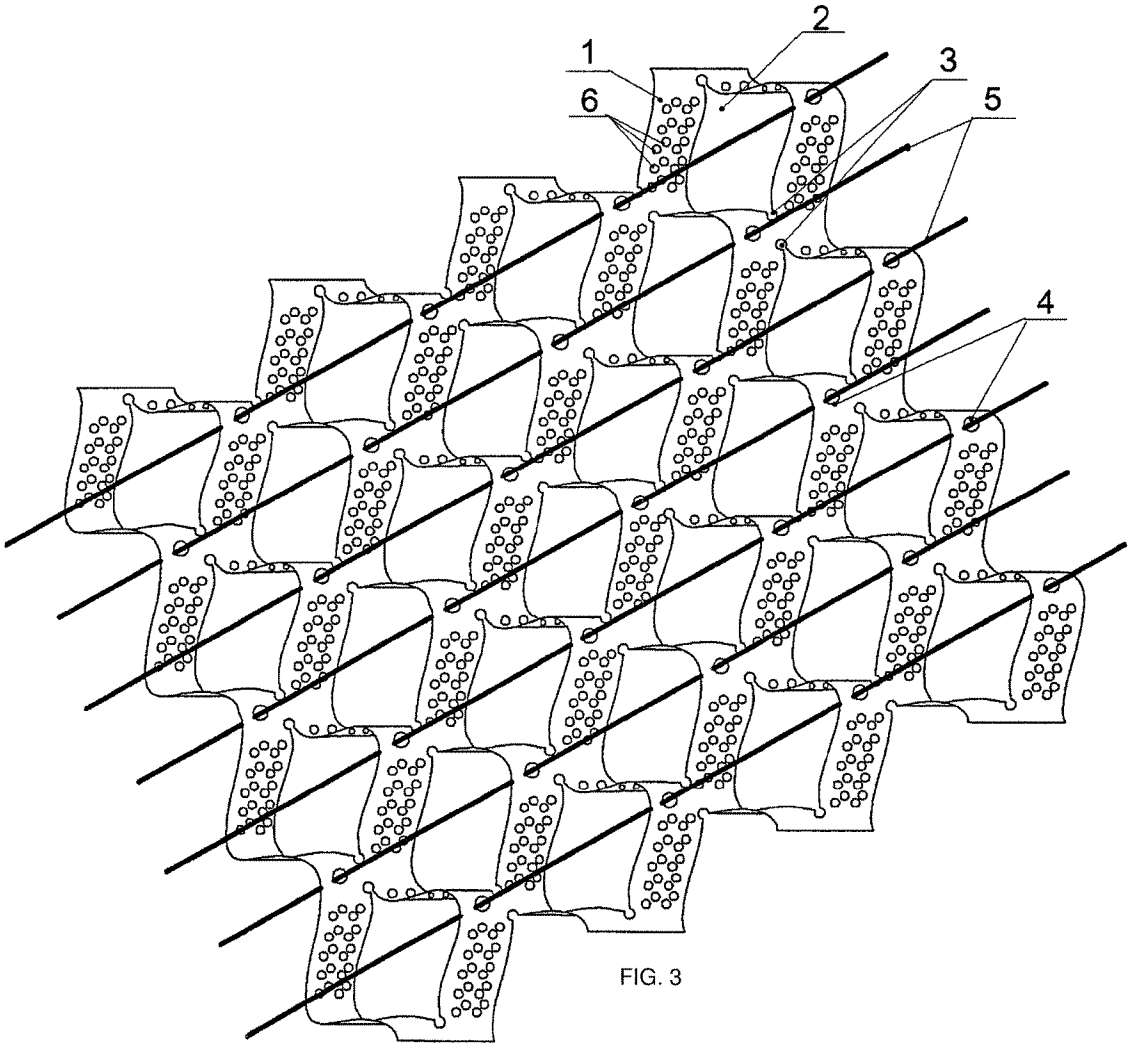
FIG. 3 shows a schematic view of an embodiment of the weld-free geocell structure with the use of tendons.

The geocell may be produced from one or more said blanks by stretching in the direction perpendicular to the lines of incisions 2 for forming a cellular confinement structure (FIGS. 2, 3). The geocell ends should be fixed on soil with the use of anchors. If several blanks (i.e. geocell sections) are used, the last openings 4 in the adjacent sections are aligned with each other and tendons 5 are drawn therethrough, thus connecting adjacent sections and, at the same time, fixing the geocell.

Depending on the purpose of the geocell, the structure cells may be filled with various fillers, such as sand, coarse gravel, peat-sand mixture, concrete, etc.

The use of the proposed blank structure and a geocell produced therefrom enables to achieve the following advantages:

- reduced degree of washing out of the geocell filler, which is especially important when reinforcing slopes;
- expanded possibilities for using the geocell in new fields requiring higher performance, e.g., on slopes and in cones of bridges on rail and motor roads, in protection facilities of pipelines and soil embankments, for bank stabilization, etc.;

improved strength of the structure in comparison with confinement geocells produced by welding of polymeric strips:

significantly higher draining capability of the structure;

lower mounting costs of the structure;

if cells are filled with concrete, the geocell may be used for ascending a slope by using steps thus formed;

furthermore, it is also possible to use the geocell structure as an information or advertising space.

It is to be noted that the claimed invention is not limited by its particular embodiments described in the specification. Any additional improvements are possible, provided they do not go beyond the scope of the proposed totality of essential features.

We claim:

1. A blank for producing a weld-free geocell, said blank comprising:

a sheet polymeric material provided with incisions, said incisions being comprised of parallel line segments, each parallel line segment having a length L, said incisions being arranged in rows, wherein incisions in adjacent rows are offset along a direction of said incisions of respective rows; and additional openings for tendons so as to fix said sheet polymeric material in stretched state on a slope, wherein adjacent incisions in a row have a distance S between respective ends of said adjacent incisions, and wherein a relationship S/L=K1, K1 being in a range from 0.1 to 0.5, wherein said incisions in adjacent rows have a distance D from each other, and wherein a relationship D/L=K2, K2 is being in range from 0.1 to 0.7, and wherein ends of the incisions are provided with oval or circular openings, and wherein said additional openings for tendons are arranged in staggered order on parallel straight lines between the rows of the incisions, the adjacent additional openings being disposed at the distance S+L from each other in the direction longitudinal relative to the lines of the incisions and at the distance 2D from each other in the direction transverse to the lines of the incisions.

2. The blank, according to claim 1, wherein said sheet polymeric material is comprised of a strip.

3. The blank, according to claim 1, further comprising:

a mesh engaged to said sheet polymeric material, said mesh reinforcing said sheet polymeric material.

4. The blank, according to claim 3, wherein said mesh is comprised of at least one of a group consisting of an aramid fiber and a carbon fiber.

5. The blank, according to claim 1, wherein K1 is in a range from 0.3 to 0.35.

6. The blank, according to claim 1, further comprising: additional drain openings.

7. The blank, according to claim 1, wherein said sheet polymeric material is texturized.

8. A weld-free geocell, comprising:

at least one blank, according to claim 1, being stretched in the direction perpendicular to the lines of the incisions so as to form cells in a cellular confinement structure.

9. The weld-free geocell, according to claim 8, further comprising:

at least one tendon drawn through said blank so as to fix said sheet polymeric material on a slope.

10. The weld-free geocell, according to claim 9, further comprising:

at least another blank connected to said at least one blank by said at least one tendon so as to form a geotextile web section.

11. The weld-free geocell, according to claim 8, further comprising anchors engaged to said sheet polymeric material so as to fix said sheet polymeric material in a stretched state on soil.

12. The weld-free geocell, according to claim 8, further comprising:

a filler contained in at least one cell, said filler being selected from a group consisting of: sand, coarse gravel, peat-sand mixture, and concrete.

13. A method for producing a weld-free geocell, comprising the steps of:

providing a blank being comprised of:

a sheet polymeric material with incisions, said incisions being comprised of parallel line segments, each parallel line segment having a length L, said incisions being arranged in rows, wherein incisions in adjacent rows are offset along a direction of said incisions of respective rows; and additional openings for tendons so as to fix said sheet polymeric material in stretched state on a slope, wherein adjacent incisions in a row have a distance S between respective ends of said adjacent incisions, wherein a relationship S/L=K1, K1 being in a range from 0.1 to 0.5, wherein said incisions in adjacent rows have a distance D from each other, and wherein a relationship D/L=K2, K2 is being in range from 0.1 to 0.7;

providing the ends of said incisions with the oval or circular openings, wherein said additional openings for tendons are arranged in staggered order on parallel straight lines between the rows of the incisions, the adjacent additional openings being disposed at the distance S+L from each other in the direction longitudinal relative to the lines of the incisions and at the distance 2D from each other in the direction transverse to the lines of the incisions; and stretching the sheet material in a direction perpendicular to the parallel line segments of the incisions so as to form a cellular confinement structure.

14. The method, according to claim 13, further comprising the step of: reinforcing said sheet polymeric material with a mesh.

15. The method, according to claim 14, wherein said sheet polymeric material is texturized.

16. The method, according to claim 13, further comprising the steps of:

providing additional openings in said sheet polymeric material; and drawing tendons through said additional openings so as to fix said sheet polymeric material in a stretched state on a slope.

17. The method, according to claim 13, further comprising: providing additional drain openings in said sheet polymeric material.

* * * * *